US006921230B2

(12) United States Patent
Silay

(10) Patent No.: US 6,921,230 B2
(45) Date of Patent: Jul. 26, 2005

(54) CLOSED LOOP CONTROL SYSTEM FOR PAVEMENT SURFACING MACHINE

(75) Inventor: Louis E. Silay, Twain Harte, CA (US)

(73) Assignee: Diamond Products, Limited, Elyria, OH (US)

( * ) Notice: Subject to any disclaimer, the term of this patent is extended or adjusted under 35 U.S.C. 154(b) by 0 days.

(21) Appl. No.: 10/328,967

(22) Filed: Dec. 24, 2002

(65) Prior Publication Data

US 2004/0120766 A1 Jun. 24, 2004

(51) Int. Cl.[7] ..... E01C 23/06
(52) U.S. Cl. ..... 404/84.1; 404/75
(58) Field of Search ..... 404/72, 75, 84.05, 404/84.1, 84.5, 84.8, 112

(56) References Cited

U.S. PATENT DOCUMENTS

| | | | | |
|---|---|---|---|---|
| 3,606,742 A | * | 9/1971 | Wieneke et al. | 460/4 |
| 4,588,231 A | | 5/1986 | Silay et al. | |
| 4,614,305 A | * | 9/1986 | Fekete et al. | 241/36 |
| 5,362,176 A | * | 11/1994 | Sovik | 404/72 |
| 5,415,495 A | * | 5/1995 | Johnson | 404/84.05 |
| 5,607,205 A | * | 3/1997 | Burdick et al. | 299/1.5 |
| 5,752,783 A | * | 5/1998 | Malone | 404/84.2 |
| 6,152,648 A | * | 11/2000 | Gfroerer et al. | 404/84.05 |
| 6,186,248 B1 | | 2/2001 | Silay et al. | |
| 6,230,552 B1 | * | 5/2001 | Abe et al. | 73/104 |
| 6,558,072 B2 | * | 5/2003 | Staffenhagen et al. | 404/117 |
| 6,752,567 B2 | * | 6/2004 | Miyamoto et al. | 404/84.1 |
| 2002/0192025 A1 | * | 12/2002 | Johnson | 404/75 |

OTHER PUBLICATIONS

Flyer, "Grooving & Grinding are Cost Effective Ways to Restore Pavement Surfaces," International Grooving & Grinding Association, Coxsackie, New York, 4 pages.

Technical Bulletin TB–008 P 1990, "Diamond Grinding and Concrete Pavement Restoration 2000," *Concrete Pavement Technology*, American Concrete Pavement Association, 1998, Skokie, Illinois, 15 pages.

The Concrete Pavement Restoration Guide, "Procedures for Preserving Concrete Pavements," *Concrete Paving Technology*, American Concrete Pavement Associate, 1998, Skokie, Illinois, 24 pages.

* cited by examiner

*Primary Examiner*—Thomas B. Will
*Assistant Examiner*—Alexandra Pechhold
(74) *Attorney, Agent, or Firm*—Rankin, Hill, Porter & Clark LLP

(57) ABSTRACT

Apparatus and methods for controlling the operation of a pavement surfacing machine are described. One embodiment that controls a pavement surfacing machine having a vehicle moveable in a preselected direction of travel along a pavement surface under the influence of a prime mover and configured to urge a rotatable grinding head against the pavement surface includes at least one sensor configured to measure a preselected operational parameter of the pavement surfacing machine and provide an output representative of the parameter and a controller that is configured to control the rate at which the vehicle moves in response to the sensor output.

15 Claims, 3 Drawing Sheets

CLOSED LOOP CONTROL SYSTEM FOR PAVEMENT SURFACING MACHINE

FIELD OF THE INVENTION

This invention relates generally to road working or repair equipment and more particularly to a novel road or pavement surfacing machine.

BACKGROUND

Unevenness of a road surface can reduce the useful life of the road. When a vehicle rides over an uneven road surface, it tends to bounce vertically on its suspension resulting in dynamic loading of the road. The forces created in this way are significantly greater than the static load due to the weight of the vehicle. These increased forces create damaging stresses on the pavement materials used in road construction and consequently decrease road life.

Road unevenness is attributable to a number of sources including the curling or warping of adjacent concrete slabs used in road construction. Other sources of unevenness include wheel wear and sub-base movement. Diamond grinding can be used to eliminate road surface unevenness by using diamond-impregnated saw blades to grind away material creating a new, smoother road surface. Diamond impregnated blades can also be used to introduce grooves running parallel to the direction of vehicle travel. Such grooves act as drainage channels for water between tires and pavement, and thus reduce skidding and hydroplaning accidents without increasing the dynamic forces experienced by the road surface. An example of a pavement surfacing machine that utilizes diamond grinding is described in U.S. Pat. No. 4,588,231 to Silay et al., which is incorporated herein by reference in its entirety.

Diamond-impregnated saw blades are typically circular and are ganged together on a common axle to form a grinding head several feet wide. The head is rotated and held against the road surface as it is moved in a direction perpendicular to its axis to grind away a portion of the road surface. The spacing between the diamond blades determines the type of cut. Narrow spacing typically results in the pavement surface being ground, whereas increasing the spacing results in grooving. A mechanism is also normally employed to maintain the head at a uniform height, thereby causing the cut surface to be smooth and level under normal operating conditions. One such mechanism that is commonly employed is a set of wheels that ride along the cut surface of the pavement behind the cutting head and another set of wheels that ride along the uncut surface of the pavement a substantial distance ahead of the cutting head.

Diamond impregnated saw blades wear during grinding, however, and are expensive and time-consuming to replace. A key consideration in diamond grinding is the lifetime of the blades, which is maximized if the blades are rotated at a rate within a specified range of optimal angular velocities and if the torque load on the blades is held within a specified range. Excessive angular velocities or torque loads can result in the blades wearing more rapidly than necessary to perform a desired grind, while insufficient angular velocities or torque loading can polish the cutting surfaces of the blades. Polishing dulls the blades and severely inhibits their ability to perform road surface grinding.

The amount of material ground from a road surface is often referred to as the depth of cut. Achieving a smooth surface typically requires cutting from the pavement surface an amount of material that varies over time, thereby creating a varying depth of cut. However, when a surface is ground by a diamond-impregnated cutting head moving at a constant angular velocity and a constant forward speed, the torque loading of the head varies with the depth of cut required. In this environment, an operator must manually alter the forward travel speed of the diamond-impregnated cutting head in response to varying loads to maintain the angular velocity of the blade and the torque loading on the blade within their optimal ranges. This requires a high level of operator skill and creates a risk that the operator will select a forward travel speed that will damage the blades.

SUMMARY OF INVENTION

The present invention provides closed loop control systems and methods for controlling the operation of a pavement surfacing machine. In one form, the invention monitors operating parameters of a pavement surfacing machine to control the forward travel speed of the pavement surfacing machine and to achieve an even cut while increasing productivity and grinding head blade life.

One embodiment that controls a pavement surfacing machine having a vehicle moveable in a preselected direction of travel along a pavement surface under the influence of a prime mover and configured to urge a rotatable grinding head against the pavement surface includes a controller and at least one sensor configured to measure a preselected operational parameter of the pavement surfacing machine and provide an output representative of the parameter. The controller is configured to control the rate at which the vehicle moves in response to the sensor output.

In another embodiment, the preselected operational parameter is indicative of the weight on the depth control assemblies and the controller is configured to decrease the speed of the vehicle when the weight on the depth control assemblies falls below a predetermined threshold. In a further embodiment, the sensor is a load cell connected to the controller and located within a depth control assembly for measuring the weight on the depth control assembly.

In yet another embodiment, the preselected operational parameter is indicative of the rotational speed of the grinding head and the controller is configured to increase the speed of the vehicle when the rotational speed of the grinding head is greater than a predetermined threshold and decrease the speed of the vehicle when the rotational speed of the grinding head is less than a predetermined threshold. In a still further embodiment, the sensor is an electronic load control module connected to the controller and located within a grinding engine to measure the power output of the grinding engine.

Yet another embodiment again also includes an engine connected to a hydraulic system for moving the vehicle and involves a sensor that is a rotary transducer mounted on the front wheel of the vehicle.

The method of the invention may include measuring a preselected operational parameter of the pavement surfacing machine and moving the pavement surfacing machine at a rate dependent upon the operational parameter. In an alternative embodiment, the operational parameter is indicative of the weight on the depth control assemblies, the speed of the pavement surfacing machine is decreased when the weight on the depth control assemblies falls below a predetermined threshold.

In another alternative embodiment, the operational parameter is indicative of the rotational speed of the grinding head, the speed of the pavement surfacing machine is increased when the rotational speed of the grinding head is greater than a predetermined threshold and the speed of the pavement surfacing machine is decreased when the rotational speed of the grinding head is less than a predetermined threshold.

In a further alternative embodiment, the operational parameter is the speed of the pavement surfacing machine.

In a still further alternative embodiment, the operational parameter is the output power of the grinding engine and the speed of the pavement surfacing machine is decreased when the output power of the grinding engine exceeds a predetermined threshold.

DETAILED DESCRIPTION

Figure 1:
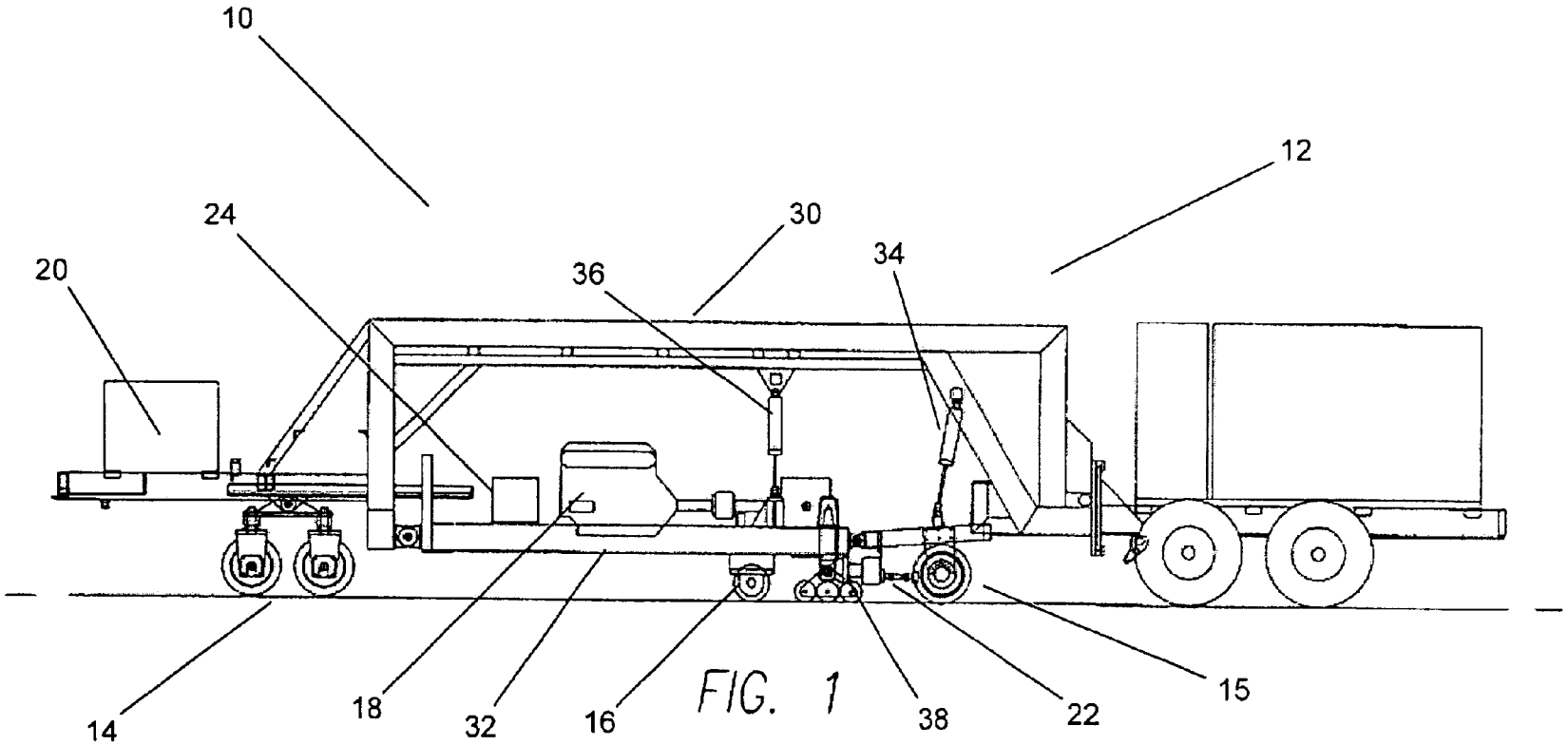
FIG. 1 is a side view of an embodiment of a pavement surfacing machine in accordance with one embodiment of the present invention.

Referring to the drawings, a pavement surfacing machine 10 constructed according to an embodiment of the invention includes a frame 12 that is supported by wheels 14, 15 and on which a grinding head 16 is mounted for rotation. The pavement surfacing machine also includes two engines. A grinding engine 18 is used to provide mechanical power for rotation of the grinding head and an auxiliary engine 20 is used to provide hydraulic power to a drive axle assembly 22 for moving the pavement surfacing machine. The speed of the movement of the pavement surfacing machine during a grind is controlled by a closed loop control system 24, which monitors operational parameters of the pavement surfacing machine and adjusts its forward travel speed accordingly.

Turning now to FIG. 1, an embodiment of a pavement surfacing machine in accordance with the invention is shown that includes a frame 12 propelled by an auxiliary engine 20, a grinding head 16 driven by a grinding engine 18 and a closed loop control system 24. The frame of the pavement surfacing machine includes an overhead frame 30 and a hinged mainframe 32. A front set of wheels 14 are connected to the overhead frame and a rear set of wheels 15 are mounted to the mainframe. The weight of the upper frame bears on the rear wheels via a traction cylinder 34. The grinding head is mounted to the mainframe and the weight of the upper frame can also be used to urge the grinding head against a road surface via mainframe cylinders 36. The position of the mainframe relative to the pavement surface is controlled by a pair of depth control assemblies 38 positioned on either side of the main frame. The details of these features of the pavement surfacing machine are set forth in U.S. Pat. No. 4,588,231 to Silay et al., the disclosure of which was incorporated by reference above.

When in operation, the grinding head rotates in a direction opposite to the rotation of the wheels of the pavement surfacing machine. This is referred to as "up cutting" and tends to cause the grinding head to be pulled down into the cut as it cuts. However, if the pavement surfacing machine moves at a speed that prevents the grinding head from removing all of the material encountered by the blades, then the blades will ride up out of the cut. This riding up is discernible as a decrease in the load on the depth control assemblies. In a heavy cut the grinding head may ride up a sufficient distance to lift the mainframe off the depth control assemblies, resulting in an uneven cut.

The pavement surfacing machine illustrated in FIG. 1 can use a closed loop control system in accordance with the invention to control its forward travel speed in response to varying conditions during a cut. The closed loop control system can be configured using known control techniques to achieve one or more objectives and typically seeks to achieve these objectives by measuring operational parameters of the pavement surfacing machine and modifying the operation of the pavement surfacing machine in response to these measurements. In one embodiment, the closed loop control system is configured to rapidly cut large pavement surface areas, while maintaining a high degree of evenness and avoiding unnecessary wear or damage to the grinding head blades. In other embodiments the closed loop control system can be configured to achieve other objectives such as minimizing blade wear, achieving a cut of the required evenness irrespective of time or other similar objectives.

Figure 2:
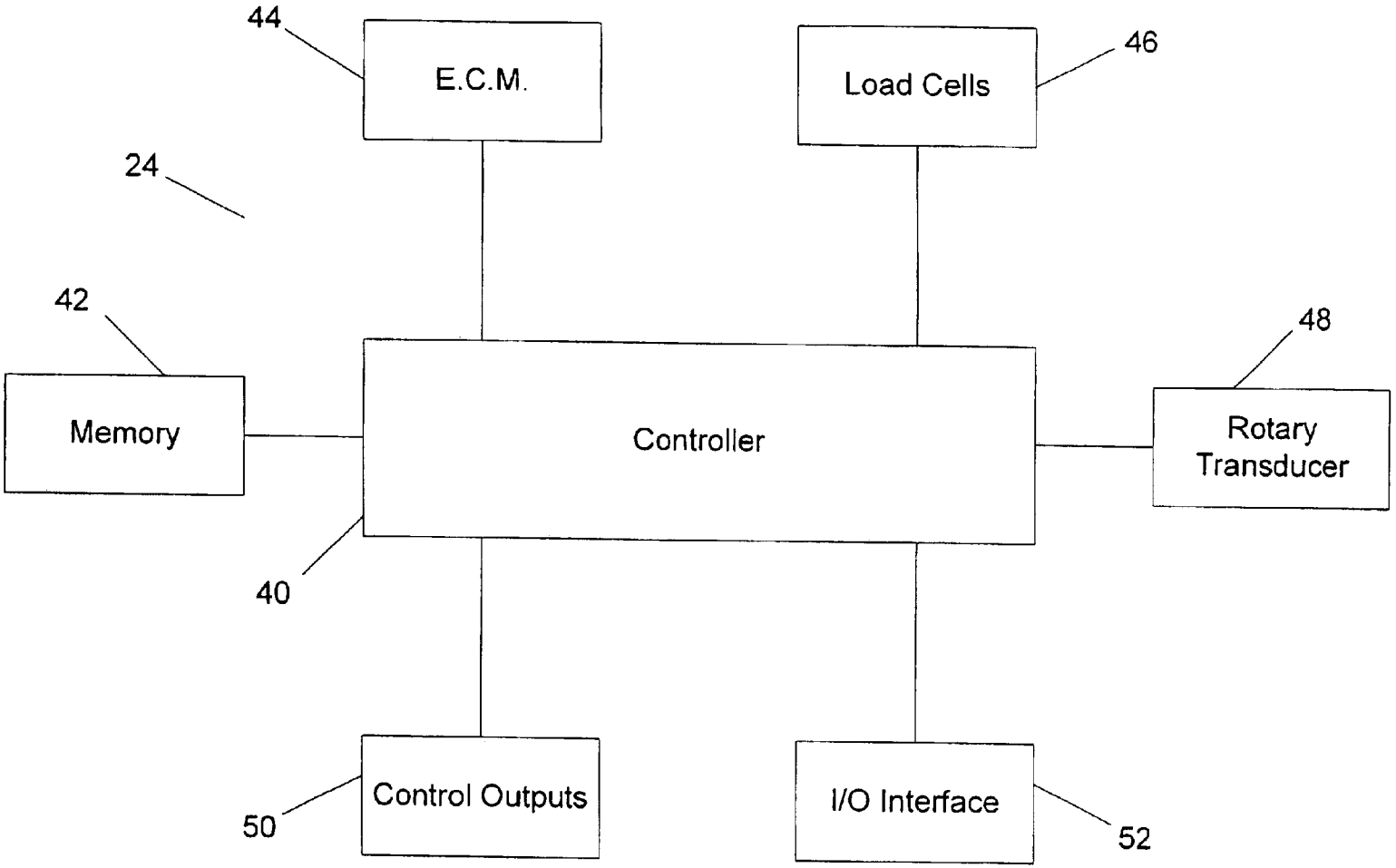
FIG. 2 is a block diagram of a closed-loop control system usable in the pavement surfacing machine of the invention.

A closed-loop control system 24 configured to rapidly cut large pavement surface areas, while maintaining a high degree of evenness and avoiding unnecessary wear or damage to the blades of the grinding head is shown in FIG. 2. The illustrated system 24 operates by controlling the forward travel speed of the pavement surfacing machine in response to the amount of power from the grinding engine that is delivered to the grinding head and the weight on the depth control assemblies. The closed-loop control system includes a controller 40 and a memory 42 for storing both data and software used in conjunction with the controller. The controller 40 generates output signals to control the forward speed of the pavement surfacing machine in response to information provided by the sensors mounted on the pavement surfacing machine.

In the illustrated embodiment, an electronic control module 44 mounted on the grinding engine provides one or more signals to the controller indicative of the power delivered to the grinding head by the grinding engine. The controller also receives input from load cells 46 mounted within each of the depth control assemblies. The load cells measure the force or weight exerted upon the depth control assembly and communicate this information to the controller. Data can also be provided to the controller by a rotary transducer 48 mounted on the front wheel of the pavement surfacing machine. The output of this rotary transducer can be used to determine the forward travel speed of the pavement surfacing machine One embodiment of the invention uses a programmable logic controller (PLC), such as Model Number SLC 500 PLC from the Allen Bradley Company, which is part of Rockwell Automation, Inc. of Milwaukee, Wis. In addition, load cells such as part number 1220AJ-50K manufactured by Interface, Inc. of Scottsdale, Ariz., can be used as the load cells within the depth control assemblies. In embodiments that use grinding head engines that have an electronic control module, such as a QSX 15 660 Horse Power Diesel Engine manufactured by Cummins, Inc. of Columbus, Ind., the electronic control module will typically generate an output indicative of the proportion of the engine power delivered to the load. When an engine lacking an electronic load control module is used as the grinding engine, then a tachometer can be used to measure the rate of rotation of the grinding head as an alternative input to the controller. The rotary transducer can be implemented using the part number 845H-SJDN22CKY2G manufactured by the Allen Bradley Company.

A number of mechanisms can be used to set or alter the forward travel speed of the pavement surfacing machine. In one such embodiment, the auxiliary engine 18 generates hydraulic flow by operating an electrically controlled hydraulic pump having a swash plate controllable via an electric signal. The magnitude of the flow generated by the swash plate determines the speed at which the pavement surfacing machine moves. Therefore, the control system can control vehicle speed by providing outputs 50 to the control card that ensure the swash plate provides the required hydraulic flow to the drive axle assembly.

A QSX 15 engine can also be used as the auxiliary engine and an example of a suitable electrically controlled hydraulic pump is the part number AA4VG56EP2D1/32RNSC52F023D manufactured by Bosch Rexroth Corporation of Hoffman Estates, Ill.

The closed-loop controller 18 can also include a user input/output ("I/O") interface 52 combining an interface such as a display screen with user controls such as an alphanumeric keyboard or keypad that can be manipulated by the user. The I/O interface enables input of operational data for use by the controller.

As previously mentioned, the controller illustrated in FIG. 2 can be configured with the objective of rapidly cutting large pavement surface areas, while maintaining a high degree of evenness and avoiding unnecessary wear or damage to the blades of the grinding head. In doing so, the closed loop controller can use the I/O interface to prompt the operator for control parameters. When a control system similar to the system described above is used, then the system can prompt the user to enter a maximum allowable forward travel speed, a maximum allowable grinding engine power output and minimum allowable depth control assembly loads. The maximum allowable forward travel speed is typically chosen based upon operator knowledge of the speed at which the machine can travel through light cuts without "riding up". In addition, the maximum allowable grinding engine power output is chosen to ensure that the blades do not wear too rapidly and the minimum allowable depth control assembly loads are chosen to provide a sufficient margin to ensure that evenness of the cut is maintained within an acceptable tolerance. User input in response to these prompts can then be provided to the controller through the I/O interface. Alternatively, the controller 40 can be pre-programmed with default values. The values entered by the user, or the default values, are then used by the controller to control the forward speed of the vehicle in response to signals received from sensors mounted on the pavement surfacing machine.

Figure 3:
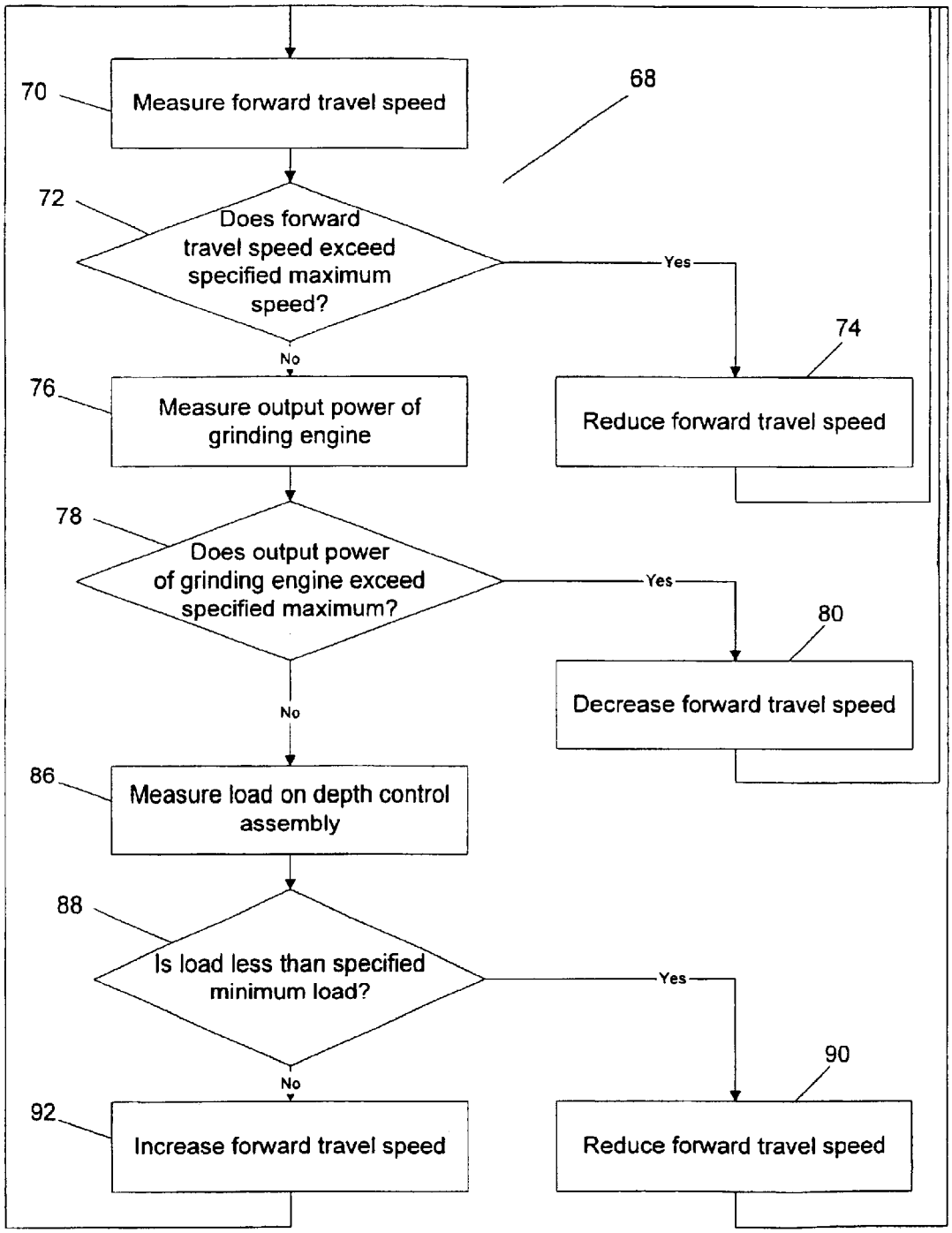
FIG. 3 is a flow chart illustrating a method of the invention for generating control signals in response to inputs from an electronic control module, a rotary transducer and load cells.

A flowchart illustrating a process for generating control signals in response to inputs from an electronic control module 44, load cells 46 and a rotary transducer 48 in accordance with the present invention is illustrated in FIG. 3. The process 68 involves determining (70) the vehicle speed using inputs from the rotary transducer. Once the speed is determined, it is compared (72) to a preselected maximum allowable vehicle speed. If the pavement surfacing machine exceeds the specified allowable maximum speed, then the control system 18 outputs (74) a signal to the hydraulic pump, which reduces the speed of the pavement surfacing machine.

If the vehicle speed is below the specified maximum allowable speed, then the power output of the grinding engine 30 is measured (76) by examining the input received from the electronic control module 44. A decision (78) as to whether the power output of the grinding engine exceeds the specified maximum allowable power output is then performed. If the measured power output of the grinding engine exceeds the specified maximum allowable power output, then the controller 40 sends (80) a signal to the hydraulic pump, which results in a decrease in the hydraulic flow delivered to the drive axle assembly and a decrease in the vehicle speed.

If the measured output power of the grinding engine is determined (78) to be equal to or less than the specified maximum allowable output power, then a measurement (86) of the load on the load cells 46 is performed. Once a measurement has been performed, a decision is made (88) as to whether the load on either of the depth control assemblies 32 is less than the specified minimum allowable load. If the load on either of the depth control assemblies is less than the minimum allowable load, indicating that the grinding head is "riding up", then a control signal is sent (90) to the hydraulic pump, which has the effect of reducing the speed of the pavement surfacing machine. This permits the grinding head to act on the high spot for a greater period of time, thereby removing sufficient material to increase the weight on the depth control assembly and causing that parameter to fall within the prescribed range. If the load on the depth control assembly is not less than the minimum threshold load, then a control signal is sent (92) to the hydraulic pump, which has the effect of increasing the forward travel speed of the pavement surfacing machine.

By specifying a maximum allowable forward travel speed, a maximum allowable power output from the grinding engine and minimum allowable depth control assembly loads, the controller can configure the control system to automatically operate the pavement surfacing machine during a grind. The above embodiment of a control system in accordance with the present invention causes a pavement surfacing machine to ramp up to the specified maximum allowable forward travel speed until a heavy cut is encountered. The increase in the power output of the grinding engine and the reduction in the weight on the depth control assemblies that result from a grinding head "riding up" during a heavy cut would typically cause the control system to respond by reducing the forward travel speed of the pavement surfacing machine until the power output of the grinding engine and the weight on the depth control assemblies had returned to acceptable levels. At which point, the control system can attempt to increase the forward travel speed. A continued heavy cut would prevent continued increase, however, the return of normal cutting conditions would see a ramping up of speed until the maximum allowable forward travel speed was obtained or another heavy cut encountered.

More specifically, to begin grinding in one embodiment an operator enters a pre-set maximum allowable forward travel speed via the control system I/O interface 52. For illustrative purposes, this may be 20 feet per minute (F.P.M.). The operator would also enter a maximum allowable grinding engine power output as a percentage of full engine power, this may be 80% of full engine power. This percentage of power is directly proportional to the torque on the grinding head blades. Next, the operator would lower the mainframe cylinders 36 and traction frame cylinder 34 until the rear wheels 15 and depth control assemblies 38 are forced into contact with the pavement. The operator would then lower the blades into the pavement surface by use of the depth control assemblies, for example to a depth of ¼". Next, the operator would use the controls of the pavement surfacing machine 10 to move the machine forward, which moves the grinding head 16 forward. This forward motion increases the load imposed on the grinding engine 18 and decreases the load on the depth control assemblies. The operator can then hand over control to the closed loop control system 24, which causes the pavement surfacing machine to ramp up to the pre-set forward travel speed of the 20 F.P.M. unless the load on the engine reaches the pre-set allowable maximum of 80% or the load on the depth control assemblies falls below the pre-set allowable minimum. The event that the load on the engine exceeds the allowable maximum load or the loads on the depth control assemblies fall below the allowable minimum loads, then the speed of the machine will be reduced until these present parameters are satisfied. However, as soon as the load on the grinding engine decreases and the load on the depth control assemblies increases to acceptable levels, then the machine can attempt to ramp back up to the pre-set maximum allowable forward travel speed.

While the above description contains many specific embodiments of the invention, these should not be construed as limitations on the scope of the invention, but rather as an example of one embodiment thereof. Many other variations are possible. For example, the vehicle drive system need not be a fluid drive. Furthermore, additional inputs can be utilized by the controller 40 in other embodiment of the invention. For example, a pavement surfacing machine can include a single depth control assembly and/or load cells located within the structures used to suspend the grinding head 16 from the vehicle 12. In addition, the controller need not be a PLC. A personal computer or another computing device with appropriate programming could be used in place of a PLC. Accordingly, the scope of the invention should be determined not by the embodiments illustrated, but by the appended claims and their equivalents.

What is claimed is:

1. A system for controlling a pavement surfacing machine having a vehicle moveable in a preselected direction of travel along a pavement surface under the influence of a prime mover and configured to urge a rotatable grinding head against the pavement surface comprising:

a controller;

at least one sensor configured to measure a preselected operational parameter of the pavement surfacing machine and provide a sensor output representative of the parameter, wherein the preselected operational paramter is indicative of the weight on a depth control assembly;

the controller being configured to generate an output signal in response to the sensor output to control the speed at which the vehicle moves in said preselected directtion of travel by decreasing said speed when the weight on the depth control assembly falls below a predetertermined threshold.

2. A system for controlling a pavement surfacing machine having a vehicle moveable in a preselected direction of travel along a pavement under the influence of a prime mover and configured to urge a rotatable grinding head against the pavement surface, comprising:

a controller;

at least one sensor configured to measure a preselected operational parameter of the pavement surfacing machine and provide a sensor output representative of the parameter, wherein the preselected operational parameter is indicative of the weight on a depth control assembly;

the controller being configured to generate an output signal in response to the sensor output to control the speed at which the vehicle moves in said preselected direction of travel increasing said speed when the weight on the depth control assembly exceeds a predetermined threshold.

3. A system for controlling a pavement surfacing machine having a vehicle moveable in a preselected direction of travel along a pavement surface under the influence of a prime mover and configures to urge a rotatable grinding head against the pavement surface, comprising:

a controller;

at least one sensor configured to measure a preselected operational parameter of the pavement surfacing machine and provide a sensor output representative of the parameter wherein the preselected operational parameter is indicative of the weight on a depth control assembly, the sensor being a load cell connected to the controller and located within the depth control assembly for measuring the weight on the depth control assembly;

the controller being configured to generate an output signal in response to the sensor output to control the speed at which the vehicle moves in said preselected direction of travel.

4. A system for controlling a pavement surfacing machine having a vehicle moveable in a preselected direction of travel along a pavement surface under the influence of a prime mover and configured to urge a rotatable grinding head against the pavement surface, comprising:

a controller;

at least one sensor configured to measure a preselected operational parameter of the pavement surfacing machine and provide a sensor output rpresentative of the parameter, wherein the preselected operational parameter is indicative of the rate of rotation of the grinding head;

the controller being configured to generate an output signal in response to the sensor output to control the speed at which the vehicle moves in said preselected direction of travel by increasing said speed when the rate of rotation of the grinding head is greater than a predetermined threshold.

5. A system for contolling a pavement surfacing machine having a vehicle moveable in a preselected direction of travel along a pavement surface under the influence of a prime mover and configured to urge a rotatable grinding head against the pavement surface, comprising:

a controller;

at least one sensor configured to measure a preselected operational parameter of the pavement surfacing machine and provide a sensor output representative of the parameter, wherein the preselected operational parameter is indicative of the rate of rotation of the grinding head;

the controller being configured to generate an output signal in response to the sensor output to control the speed at which the vehicle moves in said preselected direction of travel by decreasing said speed when the rate of rotation of the grinding head is less than a predetermined threshold.

6. A system for controller a pavement surfacing machine having a vehicle moveable in a preselected direction of travel along a pavement surface under the influence of a prime mover and configured to urge a rotatable grinding head against the pavement surface, comprising:

a controller;

at least one sensor configured to measure a preselected operational parameter of the pavement surfacing machine and provide a sensor output representative of the parameter, wherein the preselected operational parameter is indicative of the rate of rotation of the grinding head and the sensor is an electronic control module connected to the controller and located within a grinding engine to measure the power output of the grinding engine;

the controller being configures to generate an output signal in response to the sensor output to control the speed at which the vehicle moves in said preselected direction of travel.

7. A system for controlling a pavement surfacing machine having a vehicle moveable in a preselected direction of travel along a pavement surface under the influence of a prime mover and configured to urge a rotatable grinding head against the pavement surface comprising:

an engine connected to a hydraulic system for moving the vehicle;

a controller;

at least one sensor configured to measure a preselected operational parameter of the pavement surfacing machine and provide a sensor output representative of the parameter, the sensor comprising a rotary transducer connected to a front wheel of the vehicle;

wherein the controller is configured to generate an output signal in response to the sensor output to control the speed at which the vehicle moves in said preselected direction of travel.

8. A method of controlling the speed at which a rotatable grinding head mounted on a pavement surfacing machine advances in a preselected direction of travel comprising:

measuring a preselected operational parameter of the pavement surfacing machine, wherein the operational parameter is indicative of the weight on a depth control assembly;

generating an output signal in response to said measured parameter, and moving the pavement surfacing machine in said preselected direction of travel along a pavement surface at a speed determined by said output signal, said speed being decreased when the weight on the depth control assembly falls below a predetermined threshold.

9. A method of congrolling the speed at which a rotatable grinding head mounted on a pavement surfacing machine advances in a preselected direction of travel comprising:

measuring a preselected operational parameter of the pavement surfacing machine, wherein the operational parameter is indicative of the weight on a depth control assembly;

generating an output signal in response to said measured parameter, and moving the pavement surfacing machine in said preselected direction of travel along a pavement surface at a speed determined by said output signal, said speed being increased when the weight on the depth control assembly exceeds a predetermined threshold.

10. A method of controlling the speed at which a rotatable grinding head on a pavement surfacing machine advances in a preselected direction of travel comprising:

measuring a preselected operational parameter of the pavement surfacing machine, wherein the operational parameter is indicative of the rate of rotation of the grinding head;

generating an output signal in response to said measured parameter, and moving the pavement surfacing machine in said preselected direction of travel along a pavement surface at a speed determined by said input signal.

11. The method of claim 10, wherein said speed is increased when the rate of rotation of the grinding head is greater than a predetermined threshold.

12. The method of claim 10, wherein said speed is decreased when the rate of rotation of the grinding head is less than a predetermined threshold.

13. A method of controlling the speed at which a rotatable grinding head mounted on a pavement surfacing machine advances in the preselected direction of travel comprising:

measuring a preselected operational parameter of the pavement surfacing machine, wherein the operational parameter is the output power of an engine driving the grinding head;

generating an output signal in response to said measured parameter; and moving the pavement surfacing machine in said preselected direction of travel along a pavement surface at a speed determined by said output signal, said speed being decreased when the output power of the grinding engine exceeds a predetermined threshold.

14. A pavement surfacing machine, comprising:

a vehicle movable in a preselected direction of travel along a pavement surface;

a prime mover for properlling the vehicle;

a grinding head mounted for rotation on the vehicle and driven at a controlled rate of rotation;

a mechanism for urging the grinding head against the pavement surface;

at least one sensor configured to measure a preselected operational parameter of the pavement surfacing machine and provide a sensor output representative of the parameter; and a controller configured to generate an output signal in response to the sensor output to control the speed of movement of the vehicle in said preselected direction.

15. The method of claim 14 wherein:

said speed is increased when the output power of an engine driving the grinding head is less than a predetermined threshold.

* * * * *